US007159535B2

(12) United States Patent
Chapman

(10) Patent No.: US 7,159,535 B2
(45) Date of Patent: Jan. 9, 2007

(54) APPARATUS FOR HEATING AND CURING POWDER COATINGS ON POROUS WOOD PRODUCTS

(75) Inventor: Michael J. Chapman, Portsmouth, RI (US)

(73) Assignee: MDF Powder Coat Systems L.L.C., Portsmouth, RI (US)

( * ) Notice: Subject to any disclaimer, the term of this patent is extended or adjusted under 35 U.S.C. 154(b) by 86 days.

(21) Appl. No.: 10/850,088

(22) Filed: May 20, 2004

(65) Prior Publication Data

US 2004/0234919 A1 Nov. 25, 2004

Related U.S. Application Data

(60) Provisional application No. 60/472,796, filed on May 21, 2003.

(51) Int. Cl.
*B05C 19/00* (2006.01)
*F26B 3/30* (2006.01)
*F27D 11/00* (2006.01)

(52) U.S. Cl. ..... 118/50.1; 118/620; 118/642; 34/266; 219/411; 432/175; 432/227; 432/230; 392/411; 392/416; 392/418; 392/435

(58) Field of Classification Search ..... 118/50.1, 118/620, 641, 642; 34/266, 270; 219/411, 219/546–548; 432/175, 227, 230; 392/418, 392/416, 411, 419, 422, 432–435; 427/557
See application file for complete search history.

(56) References Cited

U.S. PATENT DOCUMENTS 4,416,068 A * 11/1983 Nilsson et al. ..... 34/267
5,070,625 A * 12/1991 Urquhart ..... 34/268
5,398,425 A * 3/1995 Cherry et al. ..... 34/270
6,394,796 B1 * 5/2002 Smith ..... 432/229

* cited by examiner

*Primary Examiner*—Laura Edwards
(74) *Attorney, Agent, or Firm*—John R. Doherty

(57) ABSTRACT

An improved apparatus is provided for curing powdered coatings on the face of porous wood products, such as medium density fiberboard (MDF), wherein a pair of inclined infrared catalytic heaters are used to apply heat directly onto the side edges of the board. In addition, catalytic heaters that are normally used to heat and cure the face surface of the board are moved father back to reduce their effectiveness and to limit out-gassing of entrapped air from the inner low density core of the board. This arrangement also allows the coating to cure at the side edges of the board at approximately the same rate as the face of the board, promoting a more uniform curing of the powder coating.

7 Claims, 4 Drawing Sheets

APPARATUS FOR HEATING AND CURING POWDER COATINGS ON POROUS WOOD PRODUCTS

PRIORITIES

This application claims priority to my earlier filed provisional application Ser. No. 60/472,796, filed on May 21 2003.

FIELD OF THE INVENTION

This invention relates to an improved apparatus for heating and curing powder coatings on porous wood products, such as medium density fiberboard (MDF). More specifically, the invention relates an improved catalytically powered oven employing a novel arrangement of infrared catalytic heaters for heating and curing powdered coatings on MDF board.

For the past twenty-five years, the powder coating of metal parts has become a popular method of finishing. There are numerous suppliers of the powder coating catering to all segments of the metal industry, ranging from automotive to architectural to marine applications. Powder on metal has become a mature industry. The principle method of applying powder to metal parts is to charge the powder particles with typically a negative charge via a spray gun. These negative charged particles are then attracted to metal parts that are earthed via a grounded hanging device on a conveying system.

Wood or engineered wood products such as medium density fiberboard (MDF) are not naturally as conductive as typical metal parts. MDF is made to become conductive by preheatng it to a range that is between about 150 and 250 degrees Farenheight. The preheating activates the moisture content of the MDF (typically about 5–10%) causing it to become conductive. Negatively charged powder will attach to a well grounded board of MDF.

Once the powder is attached to the board, the method of curing has been by either heating the powder in a convection oven for a certain period of time or by infrared heat for a period of time that is less than that of a convection oven. The infrared heat source has been either electric resistance heaters or catalytic heaters. In recent years, catalytic heaters have attracted considerable attention as the preferred choice of infrared heat sources.

Curing powder coatings on medium density fiberboard (MDF) using an infrared heat source has given rise to certain difficult problems. MDF board is available in various thicknesses ranging from one-quarter (¼) inch through to two inches, for example. With all thicknesses, the face surfaces of the MDF board are of a considerable higher density than the core of the board. The greater the thickness of the MDF board, the greater the difference is between the core density and the face surface density. MDF board has a certain amount of naturally occurring porosity within the board structure and hence entrapped air. The greater the thickness, the greater the porosity due to the lower core density.

When heating a piece of powder coated MDF board to cause the powder to cure, the board is typically hanging in a vertical position. As the board heats up, the entrapped air expands and out-gases through the edges of the board, typically from the center of the core in the area of lowest density. During the curing process using a conventional catalytic heating oven, the face surfaces of the board are easily heated, while the edges, especially the vertical edges, do not receive a direct line of site of infrared energy. As a result, the edges of the board are the last to cure as compared to the face surfaces. This leads to a phenomena where the expanding air which is out-gassing from inside the board, bubbles and forms blisters along the side edges of the board. These blisters occur because the powder at the edges has not reached a degree of cure, as compared to the face of the board, that would prevent the blisters from forming.

SUMMARY OF THE INVENTION

The present invention provides a novel and improved apparatus for curing powder coatings on the face of porous wood products, such as medium density fiberboard (MDF), by employing catalytic infrared heaters that are disposed to apply heat directly onto the side edges of the board and thus induce a greater degree of curing the coating before the bubbles or blisters are allowed to form. The catalytic heaters are also arranged such that infrared energy or heat is directed onto the face of the board at an angle of incidence sufficient to produce a gradient of applied heat across the coating from one side edge to the other, thus assuring a uniform heating and curing of the coating. In addition, the catalytic heaters that are normally located parallel to the board are moved farther back from the board to reduce their effectiveness on heating the face of the board. The net result is that outgassing from the core is substantially reduced while at the same time the direct heating of the side edges of the board causes the powder coating to cure at approximately the same rate as the face of the board, precluding the formation of bubbles and blisters along the edges of the board.

DESCRIPTION OF THE PREFERRED EMBODIMENTS

Figure 1:
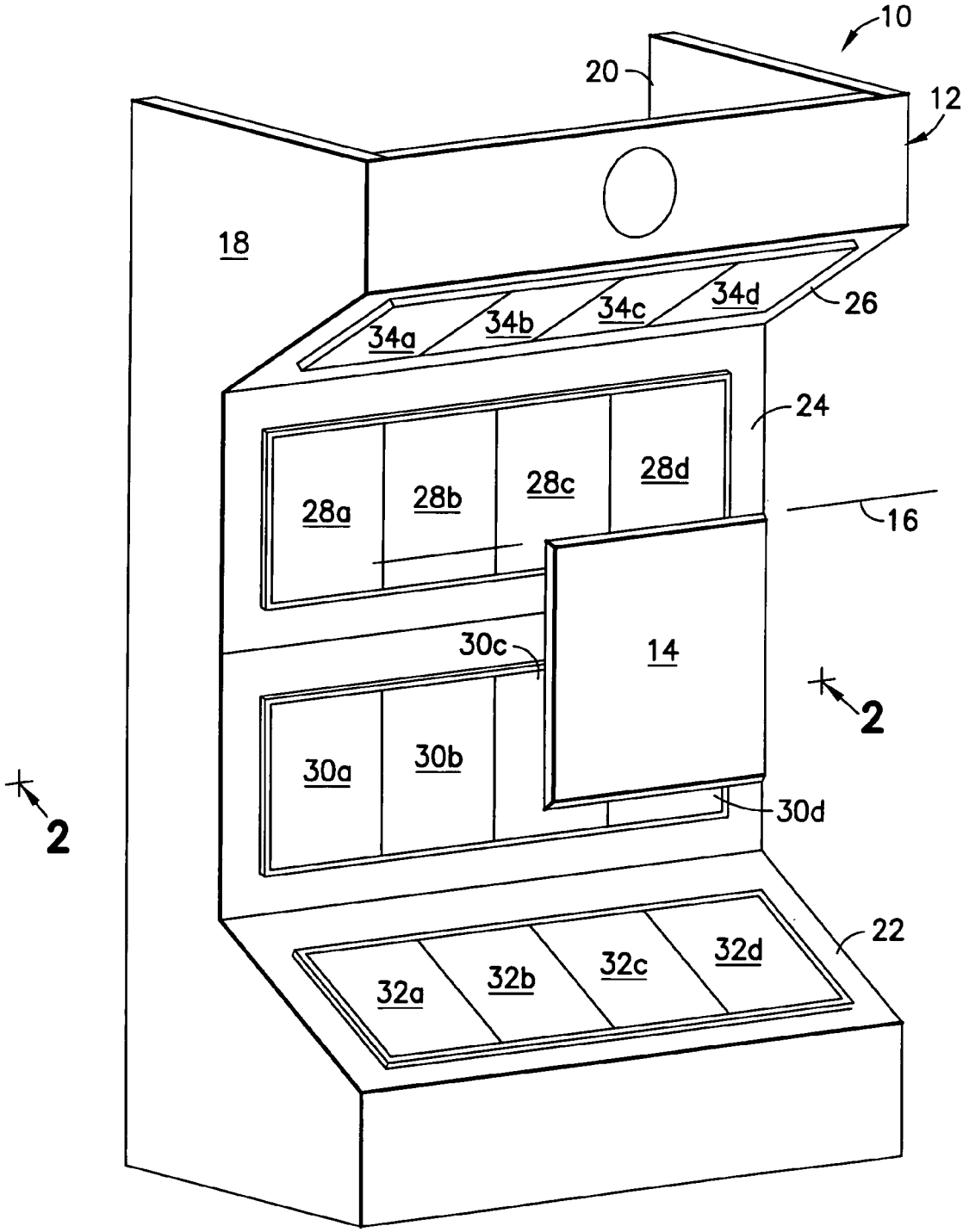
FIG. 1 PRIOR ART
FIG. 1 is an elevated perspective view of one-half section of a catalytically powered oven according the prior art. The other-half section of the oven, which is not shown in the drawing, is a mirror image of the half-section that is shown in FIG. 1. In practice, the two-half sections are joined together along a centerline to continuously treat coatings on both sides of a vertically hanging piece of porous fiberboard.
Figure 2:
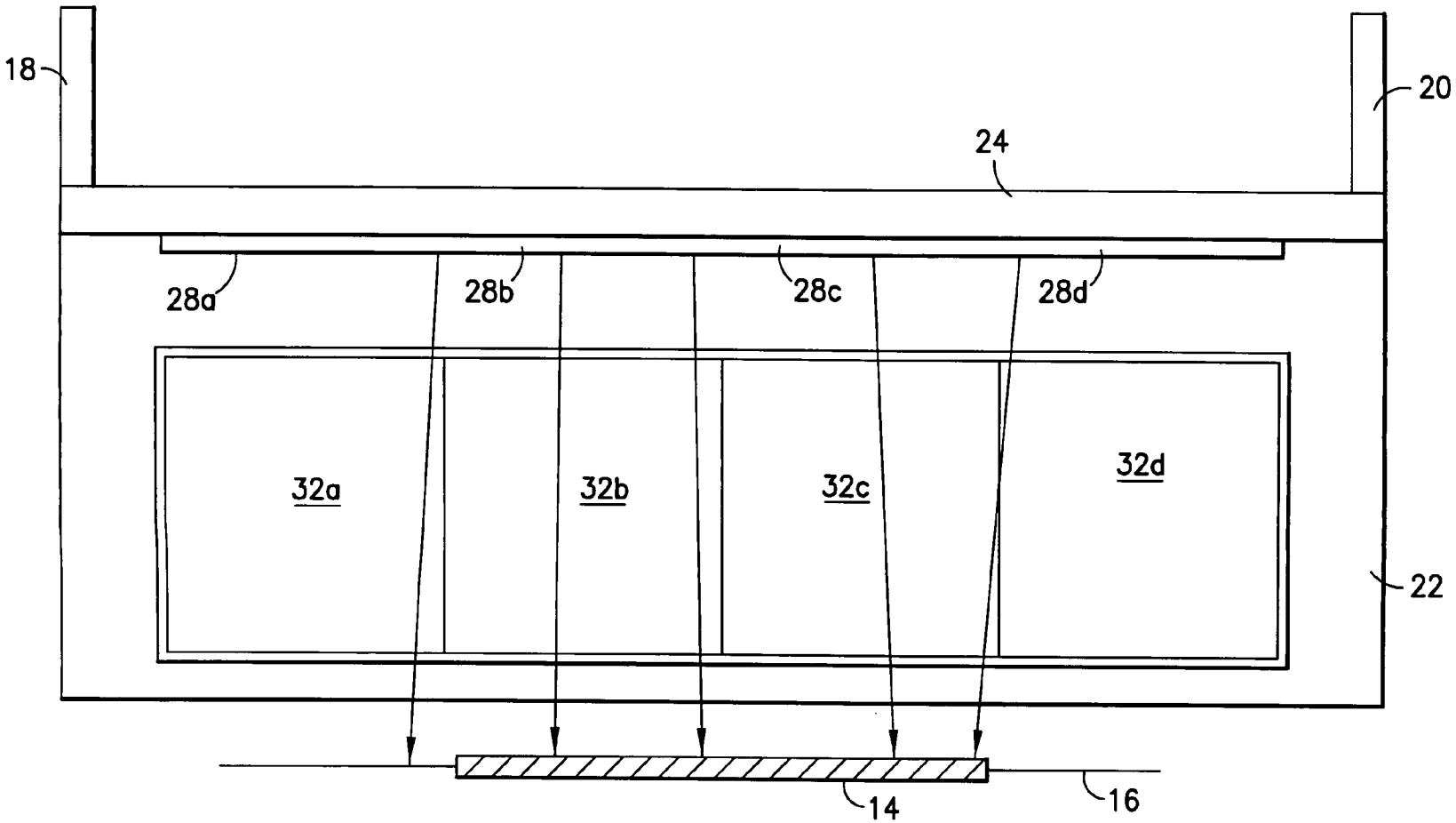
FIG.2 PRIOR ART
FIG. 2 is a cross-sectional view of the prior art catalytic oven taken through the line 2—2 in FIG. 1.

Referring now to the drawings and particularly to FIGS. 1 and 2 thereof, there is shown a one-half section 10 of a conventional catalytically powered infrared oven used to heat and cure powdered coatings on porous (MDF) fiberboard according to the prior art. As shown, the half-section 10 of the catalytic oven includes an elevated framework 12 across the front of which a piece of rectangular MDF fiberboard 14, typically about 2 feet by 3 feet, for example, is continuously transported from left to right in the view of FIG. 1. The fiberboard board 14 is moved along a centerline between the two half-sections that are joined together to heat and cure coatings on both sides of the board. The fiberboard 14 is hung in a vertical position from an overhead conveyor belt 16 and is moved along the centerline at a relatively slow speed, say about 72 to about 180 inches per minute, for example. The other half-section of the oven, which is not shown in the drawing, is a mirror image of the one-half section 10 that is shown and because the two half-sections are otherwise identical in construction, only the one half-section 10 will be described herein for the sake of simplicity.

The framework 12 is formed by two side panels 18, 20 between which are mounted a base panel 22, a back panel 24 and an overhead panel 26. The back panel 24 lies in a vertical plane which is substantially parallel to but spaced from the piece of fiberboard 14. The base panel 22 is inclined downwardly from the back panel 24 and the overhead panel 26 is inclined upwardly from the back panel 24.

The back panel 24 supports a plurality of individual catalytic heaters, in this case, an upper row of four catalytic heaters 28*a*–28*d* and a lower row of the same number of catalytic heaters 30*a*–30*d*, all of which are maintained in the same parallel spaced apart relation from the piece of MDF fiberboard 14.

The base panel 22 supports a single row of four individual catalytic heaters 32*a*–32*d* which are maintained spaced apart from and at a downwardly inclined angle with respect to the board 14. Similarly, the overhead panel 26 supports a single row of four individual catalytic heaters 34*a*–34*d* which are maintained spaced apart from but at an upwardly inclined angle with respect to the board 14. Both rows of heaters 32*a*–32*d* and 34*a*–34*d* are inclined along an axis that is parallel to the bottom and top edges of the MDF fiberboard 14 and serve to apply most all of their infrared energy onto the face surfaces of the board. While these heaters also apply some heat to the edges of the board 14, they generally do not apply any significant amount of infrared energy onto the top and bottom edges of the board.

As the piece of powder coated MDF board is heated to elevated temperatures in order to cure the coating, air that is normally always entrapped within its core during manufacture is heated owning mainly to the application of infrared heat from the two rows of heaters 28*a*–28*d* and 30*a*–30*d* on the back panel 24. This heating is also supplemented by the heat from the two rows of heaters 32*a*–32*d* and 34*a*–34*d* on the base and overhead panels 42 and 46, respectively. The entrapped air expands and out-gasses from the center core of the board in the area of lowest density, causing bubbles and blisters to form mainly on the vertical side edges of the board, with very few if any blisters forming on the top and bottom edges of the board.

Figure 3:
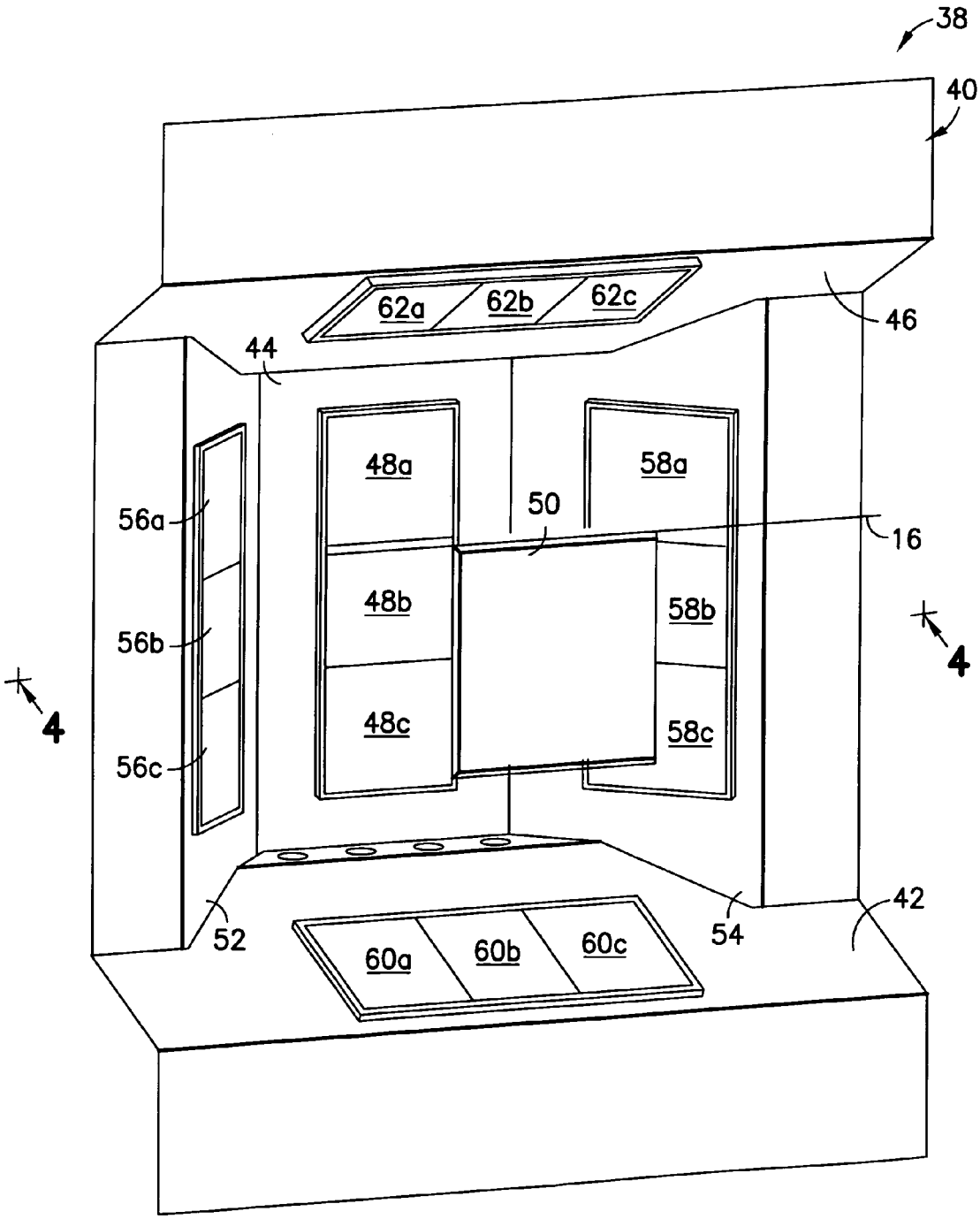
FIG. 3 is an elevated perspective view similar to FIG. 1 showing one half-section of the improved catalytically powered oven according to the invention.
Figure 4:
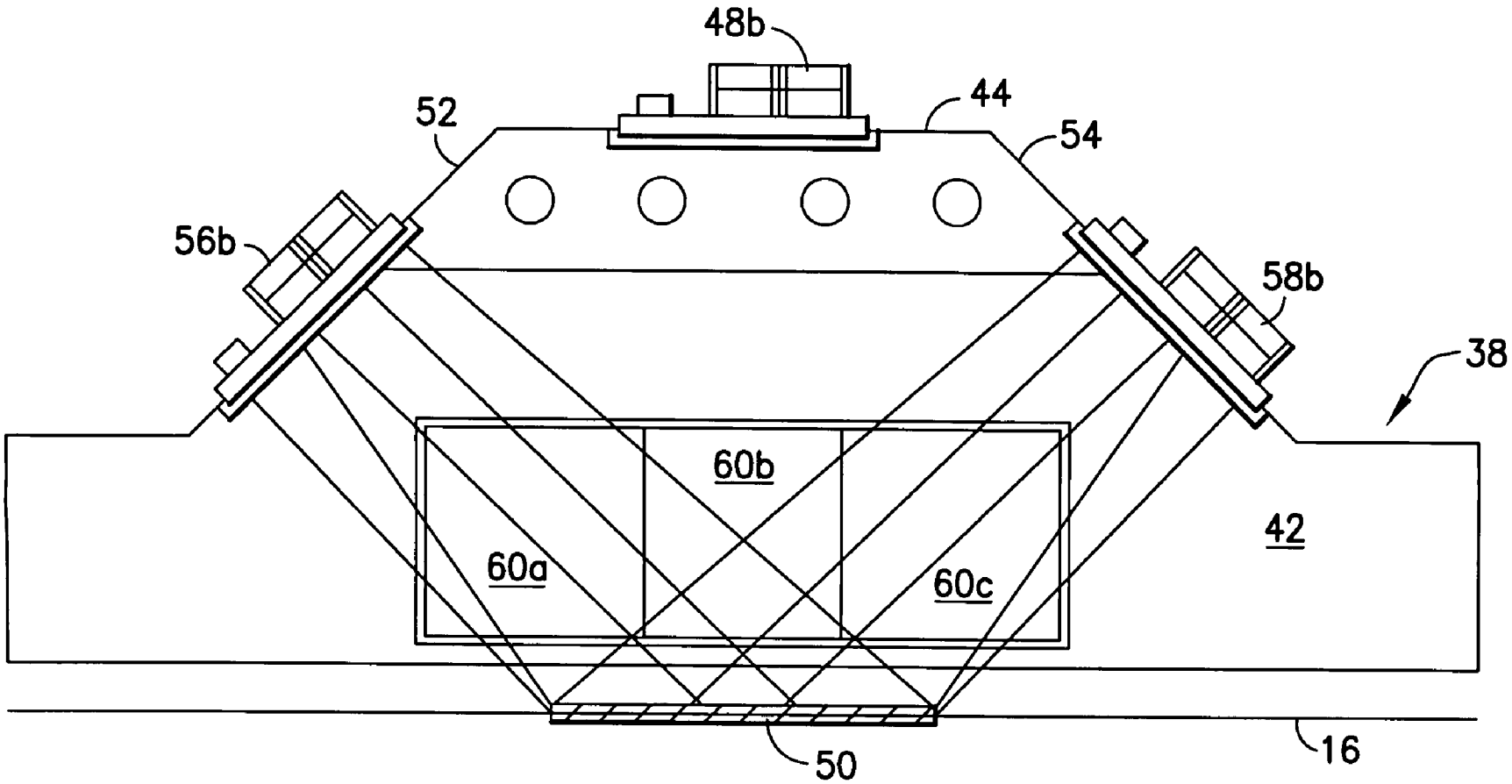
FIG. 4 is a cross-sectional view of the improved catalytic oven of the invention taken through the line 4—4 in FIG. 3.

This problem is effectively overcome by the improved apparatus of the invention which is illustrated in FIGS. 3 and 4 of the drawing. The half-section of the improved catalytically powered oven of the invention is shown generally at 38 and comprises a framework 40 which is somewhat similar to that employed in the conventional oven. The framework 40 includes a base panel 42, a back panel 44 and an overhead panel 46. The back panel 44 supports a vertical row of three catalytic heaters 48*a*–48*c* as opposed to the eight heaters used in the prior art oven. These heaters lie in a plane that is substantially parallel to the face surface of the coated porous MDF fiberboard 50. However, in this case, the row of catalytic heaters 48*a*–48*c* are also removed backward away from the board 50 a predetermined distance sufficient to reduce the infrared energy or heat that is directed at the face surface of the board. This in turn significantly reduces the amount of out-gassing that takes place from inside the core and toward the outer side edges of the board. Ideally, the center row of catalytic heaters 48*a*–48*c* are spaced a sufficient distance from the face surface of the fiberboard 50 as to account for no more than about 5 to about 50 percent of the total amount of heat applied to the coating.

The catalytic oven 38 of the invention is further developed to include a pair of outwardly inclined side panels 52, 54. These side panels 52, 54 are affixed to the back panel 44 and extend between the base panel 42 and the overhead panel 46.

The side panels 52, 54 each support a single vertical row of three catalytic heaters 56*a*–56*c* and 58*a*–58*c*, respectively. As best shown in the view of FIG. 4, these three catalytic heaters 56*a*–56*c* and 58*a*–58*c* are inclined at a predetermined angle along a vertical axis that is parallel to the vertical side edges of the board 50. Typically, these three catalytic heaters are spaced from the side edges of the board a distance ranging from between about 24 inches to about 60 inches during the time the board passes through the oven.

The three catalytic heaters 56*a*–56*c* and 58*a*–58*c* are thus arranged to apply infrared heat directly onto the opposite vertical side edges of the fiberboard 50 as clearly shown in FIG. 4. This arrangement enables the oven to heat and cure the powder coating along the side edges of the board at approximately the same rate that infrared energy or heat is applied to the face of the board by the vertical row of catalytic heaters 48*a*–48*c* on the back panel 44.

The arrangement of the inclined catalytic heaters 56*a*–56*c* and 58*a*–58*c* on the two side panels 52, 54 is further advantageous in that the heaters are each disposed to apply infrared heat across the face of the fiberboard 50 in a gradient that is of the highest intensity at the side edge of the board closest to the heaters and of the lowest intensity at the opposite side edge farthest from the heaters. In other words, the inclined vertical heaters apply heat in two intensity descending patterns across the face of the board which overlap one another and thus assure a uniform heating and curing of the coating.

In the practice of the invention, the two rows of side mounted catalytic heaters 56*a*–56*c* and 58*a*–58*c* are inclined along a vertical axis parallel to the side edges of the fiberboard 50 at an angle of between about 30 and 50 degrees, and preferably about 45 degrees, with respect to a vertical plane passing through the board 50. The angle of incidence of infrared heat directed at the surface of the board will be essentially the same as the angle to which each heater is inclined.

The single row of centerline heaters 48*a*–48*c* that are withdrawn to reduce the heating effect on the face and core of the fiberboard should generally be spaced a distance that is no closer than about 36 inches from the board. Depending upon the percent of total capacity to which the heaters are operated during use of the oven, a space of between about 36 and 60 inches should be maintained between the centerline heaters and the surface of the board. This range of operable distances, coupled with the reduced number and capacities of the catalytic heaters actually removed from the back panel 24 in the conventional ovens, amounts to about a 50 to about a 90 percent reduction in applied direct infrared heat from the conventional heater.

As can be seen in FIGS. 3 and 4, there is also provided in the improved catalytic oven of the invention a pair of horizontal rows of three catalytic heaters 60*a*–60*c* and 62*a*–62*c* supported on the base panel 42 and the overhead panel 46, respectively. These two rows of catalytic heaters are inclined along a horizontal axis that is parallel to the bottom and top edges of the vertical hanging fiberboard 50. The catalytic heaters serve to apply heat to the bottom and top edges of the hanging fiberboard. Since heat rises, the bottom heaters operate independently of the top heaters. Typically, the bottom heaters are set considerably higher in output than the top heaters.

The coating material that is applied to the porous fiberboard (MDF) and then heated and cured in accordance with the invention may generally be described as a plastic thermosetting material. Examples of such materials include, for instance, polyesters, epoxies and acrylics. The coatings may be applied by conventional methods such as by electrostatic spraying techniques as described before. The thickness of the coatings may vary generally between about 2 and 10 thousands of an inches as indicated depending upon the particular application.

The individual infrared heaters used in the catalytic oven of the invention may be made of several different designs offered by manufacturers known in the industry. A preferred catalytic heater for use in the invention is that which is described and claimed in U.S. Pat. No. 6,045,355, issued to Michael J. Chapman on Apr. 4, 2000. The maximum capacity of infrared catalytic heaters used in the invention will ordinarily be in the range of from about 12 to about 55 BTU's per square inch of heating surface. However, the heaters will usually be operated at less than maximum capacity, generally between about 5 and 80 percent of maximum capacity.

In one example of the invention, a catalytically powered oven was constructed using two half-sections of basically the same design as shown in FIGS. 3 and 4 of the drawing. A rectangular MDF board measuring about 24 by 36 inches, was supported in a vertical position from an overhead conveyor and was transported through the oven along the centerline between the two half-sections at a rate of about 10 feet per minute. The MDF board was coated on both faces with a coating consisting of an epoxy/polyester material. The thickness of the coatings was about 0.003 and 0.006 inches. All of the catalytic heaters used in the oven were rectangular in shape measuring about 16 inches wide and about 51 inches in depth and all had the same output heating capacity, that is, approximately 55 BTU's per square inch. The centerline heaters consisted of three infrared catalytic heaters arranged in a vertical row on the back panel and were spaced approximately 40 inches from the coated face of the MDF board. This compares to a spacing of about 24 inches as used in the prior art ovens and represents a reduction of about 80 percent in applied heat directly onto the face of the board. The centerline heaters were operated at about 20 to 60 percent of full capacity. The two pair of side heaters consisted of three infrared catalytic heaters arranged in a vertical row on the two side panels. The side heaters were inclined at an angle of about 45 degrees with respect to a vertical plane passing through the MDF board along a vertical axis substantially parallel to the opposite side edges of the board. The side heaters were spaced about 36 inches from the vertical edges of the board and were positioned to apply heat directly onto the side edges of the board. The heaters also directed heat across the entire coated face of the board in a gradient extending from the closest to the farthest edge of the board. The side heaters were both operated at about 10 to 60 percent of full capacity. The base heaters consisted of three catalytic heaters arranged in a horizontal row on the base panel, and similarly, the overhead heaters consisted of three catalytic heaters arranged in a horizontal row on the overhead panel. Both of the base and overhead heaters were spaced from the bottom and top edges of the MDF board a distance of about 48 inches and were mounted at an angle of approximately 45 degrees with respect to coated faces of the board. The base and overhead heaters were operated at about 50 and 30 percent of capacity, respectively. The MDF board was moved continuously between all the heaters along the centerline of the oven at about the same rate over a period of approximately 5 minutes.

The effectiveness of the invention was proved in essentially two ways by the above example. First, pieces of coated MDF board were processed through the improved oven, producing virtually blister free boards. Secondly, the degree of cure was checked, comparing the cure on the edges to the cure on the board face. Prior to the invention, it was noticeable that the degree of cure on the edges was substantially less than that on the board surface.

In summary, the invention provides a substantial improvement in catalytically powered ovens wherein infrared catalytic heaters are inclined on a vertical axis to apply infrared energy directly at the vertical edges of the MDF board. This arrangement induces a greater degree of heat in order to cure the edges of the board. Also the heaters that are located parallel to the oven centerline are moved further away from the centerline to decrease their effectiveness in heating the board surface. The net result reduces the direct infrared energy from heating up the board face and thus reducing the out-gassing, while directing infrared towards the edges of the board causing the powder coating to cure at the same rate as the face of the board, thereby preventing bobbling and the formation of blisters.

What is claimed is:

1. A catalytically powered oven for heating and curing powder coatings on a piece of porous fiberboard having at least one face surface on each side thereof and opposite side edges to which said coating is applied, said oven comprising, in combination:

a pair of half-sections each of which is a mirror image of the other;

means for transporting a piece of said fiberboard in a vertical position along a centerline between said pair of half-sections;

each of said half sections comprising:

a framework, said framework including a back panel and a pair of side panels one on each side of said back panel;

a first row of infrared catalytic heaters supported on one of said pair of side panels and arranged to apply heat directly onto one of said opposite side edges of said fiberboard;

a second row of infrared catalytic heaters supported on the other of said pair of side panels and arranged to apply heat directly onto the other of said opposite side edges of said fiberboard; and a third row of infrared catalytic heaters supported on said back panel and arranged to apply heat directly onto said at least one face surface of said fiberboard, said third row of infrared catalytic heaters being spaced from said at least one face surface a sufficient distance that will limit the amount of heat directed to said at least one face surface and allow said coating at said side edges of said fiberboard to cure at substantially the same rate as said coating on said at least one face surface of said fiberboard.

2. A catalytically powered oven according to claim 1, wherein said first and second row of catalytic heaters are also arranged to direct heat onto said at least one face surface of said fiberboard.

3. A catalytically powered oven according to claim 2, wherein said first and second row of catalytic heaters are each inclined along a vertical axis that is substantially parallel to one of said opposite side edges and at an angle with respect to said at least one face surface of said fiberboard.

4. A catalytically powered oven according to claim 3, wherein said angle is between about 30 and 50 degrees.

5. A catalytically powered oven according to claim 4, wherein said angle is about 45 degrees.

6. A catalytically powered oven according to claim 1, wherein said third row of catalytic heaters is spaced a sufficient distance from said at least one face surface of said fiberboard as to account for no more than about 5 to about 50 percent of the total amount of heat applied to said coating.

7. A catalytically powered oven according to claim 6, wherein said distance is within the range of from about 36 inches to about 60 inches.

* * * * *